US007460990B2

(12) United States Patent
Mehrotra et al.

(10) Patent No.: US 7,460,990 B2
(45) Date of Patent: Dec. 2, 2008

(54) EFFICIENT CODING OF DIGITAL MEDIA SPECTRAL DATA USING WIDE-SENSE PERCEPTUAL SIMILARITY

(75) Inventors: Sanjeev Mehrotra, Kirkland, WA (US); Wei-Ge Chen, Issaquah, WA (US)

(73) Assignee: Microsoft Corporation, Redmond, WA (US)

( * ) Notice: Subject to any disclaimer, the term of this patent is extended or adjusted under 35 U.S.C. 154(b) by 899 days.

(21) Appl. No.: 10/882,801

(22) Filed: Jun. 29, 2004

(65) Prior Publication Data

US 2005/0165611 A1 Jul. 28, 2005

Related U.S. Application Data

(60) Provisional application No. 60/539,046, filed on Jan. 23, 2004.

(51) Int. Cl.
*G10L 11/04* (2006.01)

(52) U.S. Cl. ..... 704/206; 704/500; 704/501; 704/200.1

(58) Field of Classification Search ..... 704/206, 704/500–504, 200.1
See application file for complete search history.

(56) References Cited

U.S. PATENT DOCUMENTS 5,438,643 A * 8/1995 Akagiri et al. ..... 704/201
5,539,829 A 7/1996 Lokhoff et al.
5,581,653 A 12/1996 Todd
5,819,214 A 10/1998 Suzuki et al.
5,845,243 A * 12/1998 Smart et al. ..... 704/200.1
6,029,126 A 2/2000 Malvar
6,115,688 A 9/2000 Brandenburg et al.

(Continued)

FOREIGN PATENT DOCUMENTS

EP 199529 7/1995

(Continued)

OTHER PUBLICATIONS

Mark Hasegawa-Johnson and Abeer Alwan, "Speech coding: fundamentals and applications," *Handbook of Telecommunications*, John Wiley and Sons, Inc., pp. 1-33 (2003). [available at http://citeseer.ist.psu.edu/617093.html].

(Continued)

*Primary Examiner*—Qi Han
(74) *Attorney, Agent, or Firm*—Klarquist Sparkman, LLP

(57) ABSTRACT

Traditional audio encoders may conserve coding bit-rate by encoding fewer than all spectral coefficients, which can produce a blurry low-pass sound in the reconstruction. An audio encoder using wide-sense perceptual similarity improves the quality by encoding a perceptually similar version of the omitted spectral coefficients, represented as a scaled version of already coded spectrum. The omitted spectral coefficients are divided into a number of sub-bands. The sub-bands are encoded as two parameters: a scale factor, which may represent the energy in the band; and a shape parameter, which may represent a shape of the band. The shape parameter may be in the form of a motion vector pointing to a portion of the already coded spectrum, an index to a spectral shape in a fixed codebook, or a random noise vector. The encoding thus efficiently represents a scaled version of a similarly shaped portion of spectrum to be copied at decoding.

9 Claims, 7 Drawing Sheets

U.S. PATENT DOCUMENTS

| | | | | |
|---|---|---|---|---|
| 6,341,165 | B1 | 1/2002 | Gbur et al. | |
| 6,393,392 | B1 | 5/2002 | Minde | |
| 6,680,972 | B1 * | 1/2004 | Liljeryd et al. | 375/240 |
| 6,760,698 | B2 | 7/2004 | Gao | |
| 6,766,293 | B1 * | 7/2004 | Herre et al. | 704/226 |
| 6,771,777 | B1 | 8/2004 | Gbur et al. | |
| 2003/0093271 | A1 | 5/2003 | Tsushima et al. | |
| 2003/0115041 | A1 | 6/2003 | Chen et al. | |
| 2003/0115042 | A1 | 6/2003 | Chen et al. | |
| 2003/0115050 | A1 | 6/2003 | Chen et al. | |
| 2003/0115051 | A1 | 6/2003 | Chen et al. | |
| 2003/0115052 | A1 | 6/2003 | Chen et al. | |
| 2003/0233234 | A1 * | 12/2003 | Truman et al. | 704/256 |
| 2003/0236580 | A1 | 12/2003 | Wilson et al. | |
| 2004/0243397 | A1 | 12/2004 | Averty et al. | |
| 2005/0065780 | A1 | 3/2005 | Wiser et al. | |
| 2005/0108007 | A1 | 5/2005 | Bessette et al. | |
| 2005/0149322 | A1 | 7/2005 | Bruhn et al. | |
| 2005/0165611 | A1 | 7/2005 | Mehrotra et al. | |

FOREIGN PATENT DOCUMENTS

| | | |
|---|---|---|
| EP | 0910927 | 4/1999 |
| EP | 0931386 | 7/1999 |
| EP | 1396841 | 3/2004 |
| WO | WO 02/43054 | 5/2002 |

OTHER PUBLICATIONS

Najafzadeh-Azghandi, Hossein and Kabal, Peter, "Perceptual coding of narrowband audio signals at 8 Kbit/s" (1997), available at http://citeseer.ist.psu.edu/najafzadeh-azghandi97perceptual.html.

Painter, T. and Spanias, A., "Perceptual Coding Of Digital Audio," *Proceedings Of The IEEE*, vol. 88, Issue 4, pp. 451-515, Apr. 2000, available at http://www.eas.asu.edu/~spanias/papers/paper-audio-tedspanias-00.pdf.

M. Schroeder, B. Atal, "Code-excited linear prediction (CELP): High-quality speech at very low bit rates," *Proc. IEEE Int. Conf ASSP*, pp. 937-940, 1985.

Schulz, D., "Improving audio codecs by noise substitution," *Journal Of The AES*, vol. 44, No. 7/8, pp. 593-598, Jul./Aug. 1996.

Th. Sporer, Kh. Brandenburg, B. Elder, "The Use of Multirate Filter Banks for Coding of High Quality Digital Audio," *6th European Signal Processing Conference* (*EUSIPCO*), Amsterdam, vol. 1, pp. 211-214, Jun. 1992.

Advanced Television Systems Committee, *ATSC Standard: Digital Audio Compression* (*AC-3*), *Revision A*, 140 pp. (1995).

Brandenburg, "ASPEC Coding", *AES 10th International Conference*, pp. 81-90 (1991).

"ISO/IEC 11172-3, Information Technology—Coding of Moving Pictures and Associated Audio for Digital Storage Media at Up to About 1.5 Mbit/s—Part 3: Audio," 154 pp. (1993).

"ISO/IEC 13818-7, Information Technology—Generic Coding of Moving Pictures and Associated Audio Information—Part 7: Advanced Audio Coding (AAC)," 174 pp. (1997).

"ISO/IEC 13818-7, Information Technology—Generic Coding of Moving Pictures and Associated Audio Information—Part 7: Advanced Audio Coding (AAC), Technical Corrigendum 1" 22 pp. (1998).

ITU, Recommendation ITU-R BS 1115, Low Bit-Rate Audio Coding, 9 pp. (1994).

Search Report from PCT/US04/24935, dated Feb. 24, 2005.

Search Report from PCT/US06/27238, dated Aug. 15, 2007.

* cited by examiner

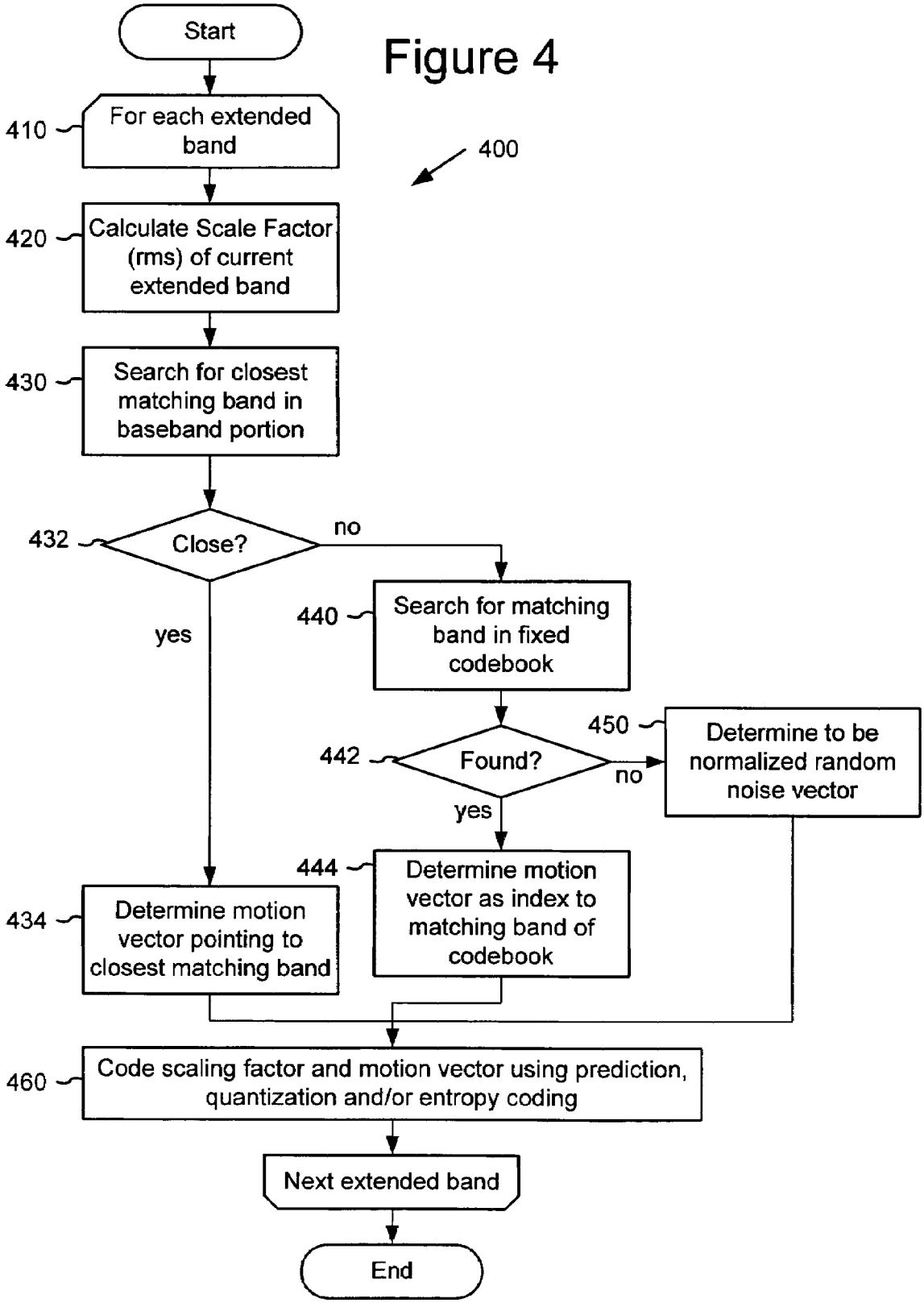
Start
Figure 4
400
410
For each extended band
420
Calculate Scale Factor (rms) of current extended band
430
Search for closest matching band in baseband portion
432
Close?
no
yes
440
Search for matching band in fixed codebook
442
Found?
no
yes
450
Determine to be normalized random noise vector
444
Determine motion vector as index to matching band of codebook
434
Determine motion vector pointing to closest matching band
460
Code scaling factor and motion vector using prediction, quantization and/or entropy coding
Next extended band
End

EFFICIENT CODING OF DIGITAL MEDIA SPECTRAL DATA USING WIDE-SENSE PERCEPTUAL SIMILARITY

CROSS-REFERENCE TO RELATED APPLICATION

This application claims the benefit of U.S. Provisional Patent Application Ser. No. 60/539,046, filed Jan. 23, 2004, the disclosure of which is incorporated herein by reference.

TECHNICAL FIELD

The invention relates generally to digital media (e.g., audio, video, still image, etc.) encoding and decoding based on wide-sense perceptual similarity.

BACKGROUND

The coding of audio utilizes coding techniques that exploit various perceptual models of human hearing. For example, many weaker tones near strong ones are masked so they don't need to be coded. In traditional perceptual audio coding, this is exploited as adaptive quantization of different frequency data. Perceptually important frequency data are allocated more bits, and thus finer quantization and vice versa. See, e.g., Painter, T. and Spanias, A., "Perceptual Coding Of Digital Audio," Proceedings Of The IEEE, vol. 88, Issue 4, April 2000, pp. 451-515.

Perceptual coding, however, can be taken to a broader sense. For example, some parts of the spectrum can be coded with appropriately shaped noise. See, Schulz, D., "Improving Audio Codecs By Noise Substitution," Journal Of The AES, vol. 44, no. 7/8, July/August 1996, pp. 593-598. When taking this approach, the coded signal may not aim to render an exact or near exact version of the original. Rather the goal is to make it sound similar and pleasant when compared with the original.

All these perceptual effects can be used to reduce the bit-rate needed for coding of audio signals. This is because some frequency components do not need to be accurately represented as present in the original signal, but can be either not coded or replaced with something that gives the same perceptual effect as in the original.

SUMMARY

A digital media (e.g., audio, video, still image, etc.) encoding/decoding technique described herein utilizes the fact that some frequency components can be perceptually well, or partially, represented using shaped noise, or shaped versions of other frequency components, or the combination of both. More particularly, some frequency bands can be perceptually well represented as a shaped version of other bands that have already been coded. Even though the actual spectrum might deviate from this synthetic version, it is still a perceptually good representation that can be used to significantly lower the bit-rate of the signal encoding without reducing quality.

Most audio codecs use a spectral decomposition using either a sub-band transform or an overlapped orthogonal transform such as the Modified Discrete Cosine Transform (MDCT) or Modulated Lapped Transform (MLT), which converts an audio signal from a time-domain representation to blocks or sets of spectral coefficients. These spectral coefficients are then coded and sent to the decoder. The coding of the values of these spectral coefficients constitutes most of the bit-rate used in an audio codec. At low bit-rates, the audio system can be designed to code all the coefficients coarsely resulting in a poor quality reconstruction, or code fewer of the coefficients resulting in a muffled or low-pass sounding signal. The encoding/decoding technique described herein can be used to improve the audio quality when doing the latter of these (i.e., when an audio codec chooses to code a few coefficients, typically the low ones, but not necessarily because of backward compatibility).

When only a few of the coefficients are coded, the codec produces a blurry low-pass sound in the reconstruction. To improve this quality, the described encoding/decoding techniques spend a small percentage of the total bit-rate to add a perceptually pleasing version of the missing spectral coefficients, yielding a full richer sound. This is accomplished not by actually coding the missing coefficients, but by perceptually representing them as a scaled version of the already coded ones. In one example, a codec that uses the MLT decomposition (such as, the Microsoft Windows Media Audio (WMA)) codes up to a certain percentage of the bandwidth. Then, this version of the described audio encoding/decoding techniques divides the remaining coefficients into a certain number of bands (such as sub-bands each consisting of typically 64 or 128 spectral coefficients). For each of these bands, this version of the audio encoding/decoding techniques encodes the band using two parameters: a scale factor which represents the total energy in the band, and a shape parameter to represent the shape of the spectrum within the band. The scale factor parameter can simply be the rms (root-mean-square) value of the coefficients within the band. The shape parameter can be a motion vector that encodes simply copying over a normalized version of the spectrum from a similar portion of the spectrum that has already been coded. In certain cases, the shape parameter may instead specify a normalized random noise vector or simply a vector from some other fixed codebook. Copying a portion from another portion of the spectrum is useful in audio since typically in many tonal signals, there are harmonic components which repeat throughout the spectrum. The use of noise or some other fixed codebook allows for a low bit-rate coding of those components which are not well represented by any already coded portion of the spectrum. This coding technique is essentially a gain-shape vector quantization coding of these bands, where the vector is the frequency band of spectral coefficients, and the codebook is taken from the previously coded spectrum and can include other fixed vectors or random noise vectors as well. Also, if this copied portion of the spectrum is added to a traditional coding of that same portion, then this addition is a residual coding. This could be useful if a traditional coding of the signal gives a base representation (for example, coding of the spectral floor) that is easy to code with a few bits, and the remainder is coded with the new algorithm.

The described encoding/decoding techniques therefore improve upon existing audio codecs. In particular, the techniques allow a reduction in bit-rate at a given quality or an improvement in quality at a fixed bit-rate. The techniques can be used to improve audio codecs in various modes (e.g., continuous bit-rate or variable bit-rate, one pass or multiple passes).

Additional features and advantages of the invention will be made apparent from the following detailed description of embodiments that proceeds with reference to the accompanying drawings.

BRIEF DESCRIPTION OF THE DRAWINGS

FIG. 4 is a flow diagram of encoding bands with the efficient audio coding using wide-sense perceptual similarity in the extended band coder of FIG. 3.

DETAILED DESCRIPTION

The following detailed description addresses digital media encoder/decoder embodiments with digital media encoding/decoding of digital media spectral data using wide-sense perceptual similarity in accordance with the invention. More particularly, the following description details application of these encoding/decoding techniques for audio. They can also be applied to encoding/decoding of other digital media types (e.g., video, still images, etc.). In its application to audio, this audio encoding/decoding represents some frequency components using shaped noise, or shaped versions of other frequency components, or the combination of both. More particularly, some frequency bands are represented as a shaped version of other bands that have already been coded. This allows a reduction in bit-rate at a given quality or an improvement in quality at a fixed bit-rate.

1. Generalized Audio Encoder and Decoder

Figure 1:
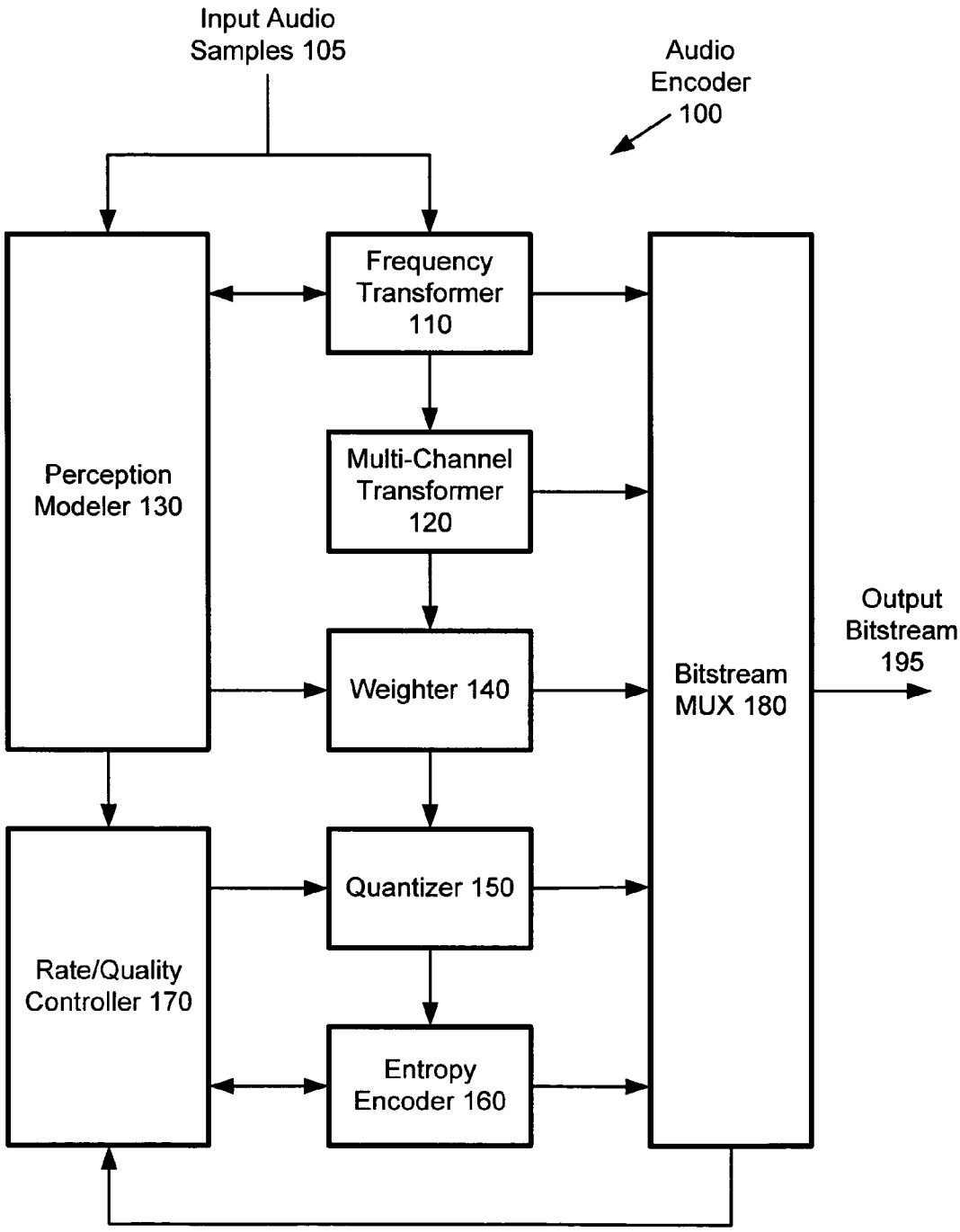
FIGS. 1 and 2 are a block diagram of an audio encoder and decoder in which the present coding techniques may be incorporated.
Figure 2:
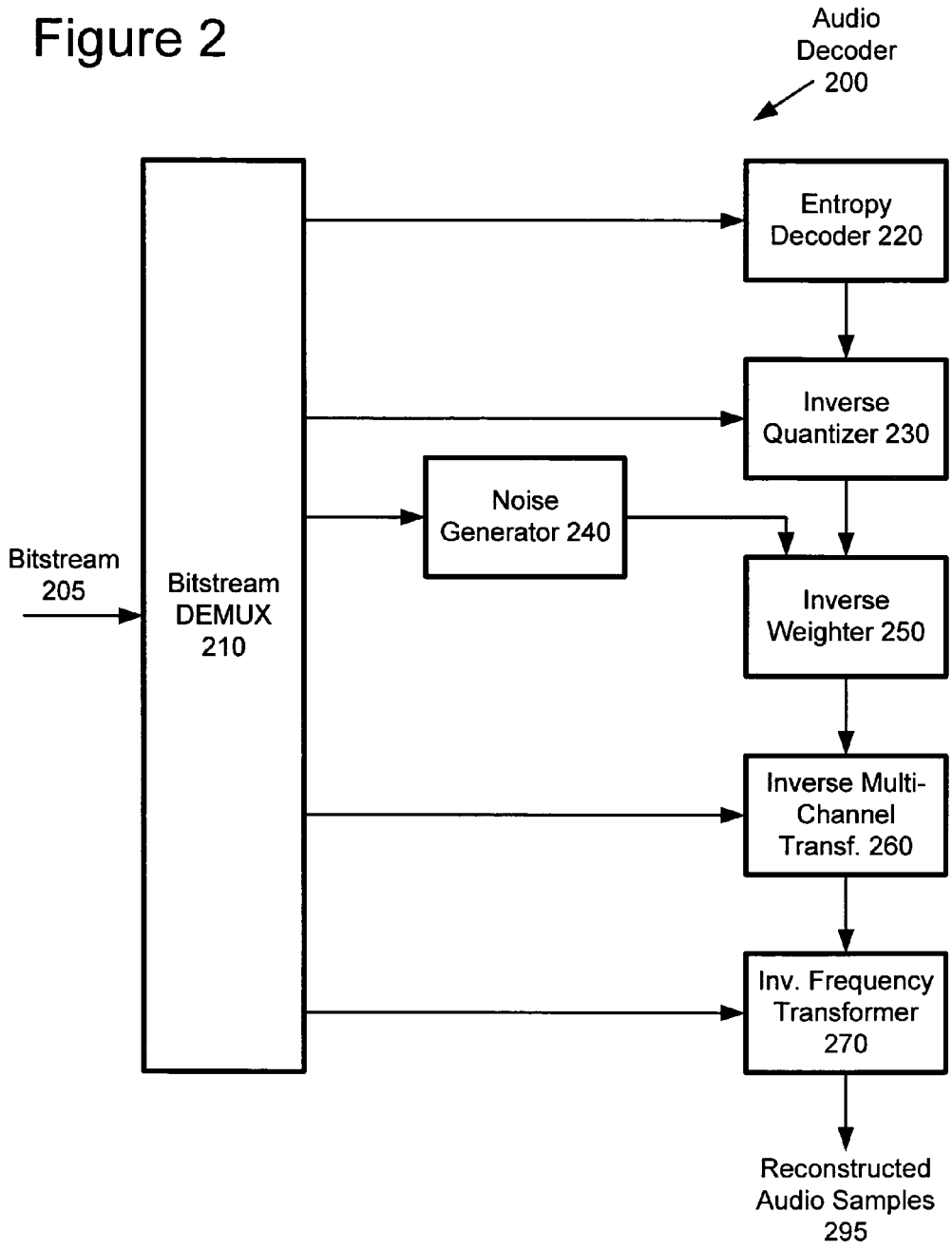

FIGS. 1 and 2 are block diagrams of a generalized audio encoder (100) and generalized audio decoder (200), in which the herein described techniques for audio encoding/decoding of audio spectral data using wide-sense perceptual similarity can be incorporated. The relationships shown between modules within the encoder and decoder indicate the main flow of information in the encoder and decoder; other relationships are not shown for the sake of simplicity. Depending on implementation and the type of compression desired, modules of the encoder or decoder can be added, omitted, split into multiple modules, combined with other modules, and/or replaced with like modules. In alternative embodiments, encoders or decoders with different modules and/or other configurations of modules measure perceptual audio quality.

Further details of an audio encoder/decoder in which the wide-sense perceptual similarity audio spectral data encoding/decoding can be incorporated are described in the following U.S. patent applications: U.S. patent application Ser. No. 10/020,708, filed Dec. 14, 2001; U.S. patent application Ser. No. 10/016,918, filed Dec. 14, 2001; U.S. patent application Ser. No. 10/017,702, filed Dec. 14, 2001; U.S. patent application Ser. No. 10/017,861, filed Dec. 14, 2001; and U.S. patent application Ser. No. 10/017,694, filed Dec. 14, 2001, the disclosures of which are hereby incorporated herein by reference.

A. Generalized Audio Encoder

The generalized audio encoder (100) includes a frequency transformer (110), a multi-channel transformer (120), a perception modeler (130), a weighter (140), a quantizer (150), an entropy encoder (160), a rate/quality controller (170), and a bitstream multiplexer ["MUX"] (180).

The encoder (100) receives a time series of input audio samples (105) in a format such as one shown in Table 1. For input with multiple channels (e.g., stereo mode), the encoder (100) processes channels independently, and can work with jointly coded channels following the multi-channel transformer (120). The encoder (100) compresses the audio samples (105) and multiplexes information produced by the various modules of the encoder (100) to output a bitstream (195) in a format such as Windows Media Audio ["WMA"] or Advanced Streaming Format ["ASF"]. Alternatively, the encoder (100) works with other input and/or output formats.

The frequency transformer (110) receives the audio samples (105) and converts them into data in the frequency domain. The frequency transformer (110) splits the audio samples (105) into blocks, which can have variable size to allow variable temporal resolution. Small blocks allow for greater preservation of time detail at short but active transition segments in the input audio samples (105), but sacrifice some frequency resolution. In contrast, large blocks have better frequency resolution and worse time resolution, and usually allow for greater compression efficiency at longer and less active segments. Blocks can overlap to reduce perceptible discontinuities between blocks that could otherwise be introduced by later quantization. The frequency transformer (110) outputs blocks of frequency coefficient data to the multi-channel transformer (120) and outputs side information such as block sizes to the MUX (180). The frequency transformer (110) outputs both the frequency coefficient data and the side information to the perception modeler (130).

The frequency transformer (110) partitions a frame of audio input samples (105) into overlapping sub-frame blocks with time-varying size and applies a time-varying MLT to the sub-frame blocks. Possible sub-frame sizes include 128, 256, 512, 1024, 2048, and 4096 samples. The MLT operates like a DCT modulated by a time window function, where the window function is time varying and depends on the sequence of sub-frame sizes. The MLT transforms a given overlapping block of samples $x[n], 0 \leqq n < subframe_size$ into a block of frequency coefficients $X[k], 0 \leqq k < subframe_size/2$. The frequency transformer (110) can also output estimates of the complexity of future frames to the rate/quality controller (170). Alternative embodiments use other varieties of MLT. In still other alternative embodiments, the frequency transformer (110) applies a DCT, FFT, or other type of modulated or non-modulated, overlapped or non-overlapped frequency transform, or use sub-band or wavelet coding.

For multi-channel audio data, the multiple channels of frequency coefficient data produced by the frequency transformer (110) often correlate. To exploit this correlation, the multi-channel transformer (120) can convert the multiple original, independently coded channels into jointly coded channels. For example, if the input is stereo mode, the multi-channel transformer (120) can convert the left and right channels into sum and difference channels:

$$X_{Sum}[k] = \frac{X_{Left}[k] + X_{Right}[k]}{2} \quad (1)$$

$$X_{Diff}[k] = \frac{X_{Left}[k] - X_{Right}[k]}{2} \quad (2)$$

Or, the multi-channel transformer (120) can pass the left and right channels through as independently coded channels.

More generally, for a number of input channels greater than one, the multi-channel transformer (120) passes original, independently coded channels through unchanged or converts the original channels into jointly coded channels. The decision to use independently or jointly coded channels can be predetermined, or the decision can be made adaptively on a block by block or other basis during encoding. The multi-channel transformer (120) produces side information to the MUX (180) indicating the channel transform mode used.

The perception modeler (130) models properties of the human auditory system to improve the quality of the reconstructed audio signal for a given bit-rate. The perception modeler (130) computes the excitation pattern of a variable-size block of frequency coefficients. First, the perception modeler (130) normalizes the size and amplitude scale of the block. This enables subsequent temporal smearing and establishes a consistent scale for quality measures. Optionally, the perception modeler (130) attenuates the coefficients at certain frequencies to model the outer/middle ear transfer function. The perception modeler (130) computes the energy of the coefficients in the block and aggregates the energies by 25 critical bands. Alternatively, the perception modeler (130) uses another number of critical bands (e.g., 55 or 109). The frequency ranges for the critical bands are implementation-dependent, and numerous options are well known. For example, see ITU-R BS 1387 or a reference mentioned therein. The perception modeler (130) processes the band energies to account for simultaneous and temporal masking. In alternative embodiments, the perception modeler (130) processes the audio data according to a different auditory model, such as one described or mentioned in ITU-R BS 1387.

The weighter (140) generates weighting factors (alternatively called a quantization matrix) based upon the excitation pattern received from the perception modeler (130) and applies the weighting factors to the data received from the multi-channel transformer (120). The weighting factors include a weight for each of multiple quantization bands in the audio data. The quantization bands can be the same or different in number or position from the critical bands used elsewhere in the encoder (100). The weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. In one implementation, the number of quantization bands varies according to block size; smaller blocks have fewer quantization bands than larger blocks. For example, blocks with 128 coefficients have 13 quantization bands, blocks with 256 coefficients have 15 quantization bands, up to 25 quantization bands for blocks with 2048 coefficients. The weighter (140) generates a set of weighting factors for each channel of multi-channel audio data in independently or jointly coded channels, or generates a single set of weighting factors for jointly coded channels. In alternative embodiments, the weighter (140) generates the weighting factors from information other than or in addition to excitation patterns.

The weighter (140) outputs weighted blocks of coefficient data to the quantizer (150) and outputs side information such as the set of weighting factors to the MUX (180). The weighter (140) can also output the weighting factors to the rate/quality controller (140) or other modules in the encoder (100). The set of weighting factors can be compressed for more efficient representation. If the weighting factors are lossy compressed, the reconstructed weighting factors are typically used to weight the blocks of coefficient data. If audio information in a band of a block is completely eliminated for some reason (e.g., noise substitution or band truncation), the encoder (100) may be able to further improve the compression of the quantization matrix for the block.

The quantizer (150) quantizes the output of the weighter (140), producing quantized coefficient data to the entropy encoder (160) and side information including quantization step size to the MUX (180). Quantization introduces irreversible loss of information, but also allows the encoder (100) to regulate the bit-rate of the output bitstream (195) in conjunction with the rate/quality controller (170). In FIG. 1, the quantizer (150) is an adaptive, uniform scalar quantizer. The quantizer (150) applies the same quantization step size to each frequency coefficient, but the quantization step size itself can change from one iteration to the next to affect the bit-rate of the entropy encoder (160) output. In alternative embodiments, the quantizer is a non-uniform quantizer, a vector quantizer, and/or a non-adaptive quantizer.

The entropy encoder (160) losslessly compresses quantized coefficient data received from the quantizer (150). For example, the entropy encoder (160) uses multi-level run length coding, variable-to-variable length coding, run length coding, Huffinan coding, dictionary coding, arithmetic coding, LZ coding, a combination of the above, or some other entropy encoding technique.

The rate/quality controller (170) works with the quantizer (150) to regulate the bit-rate and quality of the output of the encoder (100). The rate/quality controller (170) receives information from other modules of the encoder (100). In one implementation, the rate/quality controller (170) receives estimates of future complexity from the frequency transformer (110), sampling rate, block size information, the excitation pattern of original audio data from the perception modeler (130), weighting factors from the weighter (140), a block of quantized audio information in some form (e.g., quantized, reconstructed, or encoded), and buffer status information from the MUX (180). The rate/quality controller (170) can include an inverse quantizer, an inverse weighter, an inverse multi-channel transformer, and, potentially, an entropy decoder and other modules, to reconstruct the audio data from a quantized form.

The rate/quality controller (170) processes the information to determine a desired quantization step size given current conditions and outputs the quantization step size to the quantizer (150). The rate/quality controller (170) then measures the quality of a block of reconstructed audio data as quantized with the quantization step size, as described below. Using the measured quality as well as bit-rate information, the rate/quality controller (170) adjusts the quantization step size with the goal of satisfying bit-rate and quality constraints, both instantaneous and long-term. In alternative embodiments, the rate/quality controller (170) works with different or additional information, or applies different techniques to regulate quality and bit-rate.

In conjunction with the rate/quality controller (170), the encoder (100) can apply noise substitution, band truncation, and/or multi-channel rematrixing to a block of audio data. At low and mid-bit-rates, the audio encoder (100) can use noise substitution to convey information in certain bands. In band truncation, if the measured quality for a block indicates poor quality, the encoder (100) can completely eliminate the coefficients in certain (usually higher frequency) bands to improve the overall quality in the remaining bands. In multi-channel rematrixing, for low bit-rate, multi-channel audio data in jointly coded channels, the encoder (100) can suppress information in certain channels (e.g., the difference channel) to improve the quality of the remaining channel(s) (e.g., the sum channel).

The MUX (180) multiplexes the side information received from the other modules of the audio encoder (100) along with the entropy encoded data received from the entropy encoder (160). The MUX (180) outputs the information in WMA or in another format that an audio decoder recognizes.

The MUX (180) includes a virtual buffer that stores the bitstream (195) to be output by the encoder (100). The virtual buffer stores a pre-determined duration of audio information (e.g., 5 seconds for streaming audio) in order to smooth over short-term fluctuations in bit-rate due to complexity changes in the audio. The virtual buffer then outputs data at a relatively constant bit-rate. The current fullness of the buffer, the rate of change of fullness of the buffer, and other characteristics of the buffer can be used by the rate/quality controller (170) to regulate quality and bit-rate.

B. Generalized Audio Decoder

With reference to FIG. 2, the generalized audio decoder (200) includes a bitstream demultiplexer ["DEMUX"] (210), an entropy decoder (220), an inverse quantizer (230), a noise generator (240), an inverse weighter (250), an inverse multi-channel transformer (260), and an inverse frequency transformer (270). The decoder (200) is simpler than the encoder (100) is because the decoder (200) does not include modules for rate/quality control.

The decoder (200) receives a bitstream (205) of compressed audio data in WMA or another format. The bitstream (205) includes entropy encoded data as well as side information from which the decoder (200) reconstructs audio samples (295). For audio data with multiple channels, the decoder (200) processes each channel independently, and can work with jointly coded channels before the inverse multi-channel transformer (260).

The DEMUX (210) parses information in the bitstream (205) and sends information to the modules of the decoder (200). The DEMUX (210) includes one or more buffers to compensate for short-term variations in bit-rate due to fluctuations in complexity of the audio, network jitter, and/or other factors.

The entropy decoder (220) losslessly decompresses entropy codes received from the DEMUX (210), producing quantized frequency coefficient data. The entropy decoder (220) typically applies the inverse of the entropy encoding technique used in the encoder.

The inverse quantizer (230) receives a quantization step size from the DEMUX (210) and receives quantized frequency coefficient data from the entropy decoder (220). The inverse quantizer (230) applies the quantization step size to the quantized frequency coefficient data to partially reconstruct the frequency coefficient data. In alternative embodiments, the inverse quantizer applies the inverse of some other quantization technique used in the encoder.

The noise generator (240) receives from the DEMUX (210) indication of which bands in a block of data are noise substituted as well as any parameters for the form of the noise. The noise generator (240) generates the patterns for the indicated bands, and passes the information to the inverse weighter (250).

The inverse weighter (250) receives the weighting factors from the DEMUX (210), patterns for any noise-substituted bands from the noise generator (240), and the partially reconstructed frequency coefficient data from the inverse quantizer (230). As necessary, the inverse weighter (250) decompresses the weighting factors. The inverse weighter (250) applies the weighting factors to the partially reconstructed frequency coefficient data for bands that have not been noise substituted. The inverse weighter (250) then adds in the noise patterns received from the noise generator (240).

The inverse multi-channel transformer (260) receives the reconstructed frequency coefficient data from the inverse weighter (250) and channel transform mode information from the DEMUX (210). If multi-channel data is in independently coded channels, the inverse multi-channel transformer (260) passes the channels through. If multi-channel data is in jointly coded channels, the inverse multi-channel transformer (260) converts the data into independently coded channels. If desired, the decoder (200) can measure the quality of the reconstructed frequency coefficient data at this point.

The inverse frequency transformer (270) receives the frequency coefficient data output by the multi-channel transformer (260) as well as side information such as block sizes from the DEMUX (210). The inverse frequency transformer (270) applies the inverse of the frequency transform used in the encoder and outputs blocks of reconstructed audio samples (295).

2. Encoding/Decoding With Wide-Sense Perceptual Similarity

Figure 3:
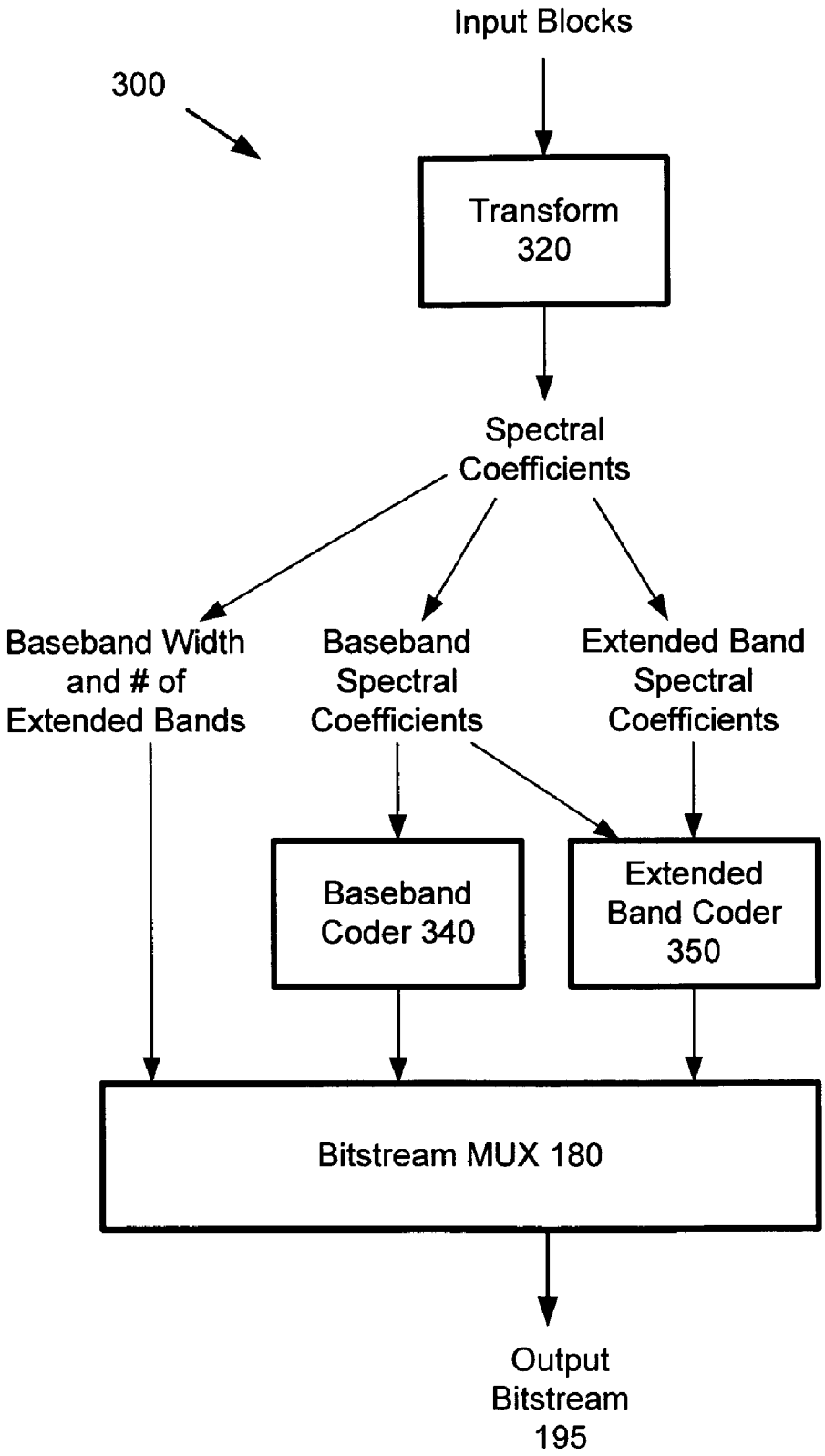
FIG. 3 is a block diagram of a baseband coder and extended band coder implementing the efficient audio coding using wide-sense perceptual similarity that can be incorporated into the general audio encoder of FIG. 1.

FIG. 3 illustrates one implementation of an audio encoder (300) using encoding with wide-sense perceptual similarity that can be incorporated into the overall audio encoding/decoding process of the generalized audio encoder (100) and decoder (200) of FIGS. 1 and 2. In this implementation, the audio encoder (300) performs a spectral decomposition in transform (320), using either a sub-band transform or an overlapped orthogonal transform such as MDCT or MLT, to produce a set of spectral coefficients for each input block of the audio signal. As is conventionally known, the audio encoder codes these spectral coefficients for sending in the output bitstream to the decoder. The coding of the values of these spectral coefficients constitutes most of the bit-rate used in an audio codec. At low bit-rates, the audio encoder (300) selects to code fewer of the spectral coefficients using a base-band coder 340 (i.e., a number of coefficients that can be encoded within a percentage of the bandwidth of the spectral coefficients output from the frequency transformer (110)), such as a lower or base-band portion of the spectrum. The baseband coder 340 encodes these baseband spectral coefficients using a conventionally known coding syntax, as described for the generalized audio encoder above. This would generally result in the reconstructed audio sounding muffled or low-pass filtered.

The audio encoder (300) avoids the muffled/low-pass effect by also coding the omitted spectral coefficients using wide-sense perceptual similarity. The spectral coefficients (referred to here as the "extended band spectral coefficients") that were omitted from coding with the baseband coder 340 are coded by extended band coder 350 as shaped noise, or shaped versions of other frequency components, or a combination of the two. More specifically, the extended band spectral coefficients are divided into a number of sub-bands (e.g., of typically 64 or 128 spectral coefficients), which are coded as shaped noise or shaped versions of other frequency components. This adds a perceptually pleasing version of the missing spectral coefficient to give a full richer sound. Even though the actual spectrum may deviate from the synthetic version resulting from this encoding, this extended band coding provides a similar perceptual effect as in the original.

In some implementations, the width of the base-band (i.e., number of baseband spectral coefficients coded using the baseband coder 340) can be varied, as well as the size or number of extended bands. In such case, the width of the baseband and number (or size) of extended bands coded using the extended band coder (350) can be coded into the output stream (195). Also, an implementation can have extended bands that are each of different size. For example, the lower portion of the extension can have smaller bands to get a more accurate representation, whereas the higher frequencies can use larger bands.

The partitioning of the bitstream between the baseband spectral coefficients and extended band coefficients in the audio encoder (300) is done to ensure backward compatibility with existing decoders based on the coding syntax of the baseband coder, such that such existing decoder can decode the baseband coded portion while ignoring the extended portion. The result is that only newer decoders have the capability to render the full spectrum covered by the extended band coded bitstream, whereas the older decoders can only render the portion which the encoder chose to encode with the existing syntax. The frequency boundary can be flexible and time-varying. It can either be decided by the encoder based on signal characteristics and explicitly sent to the decoder, or it can be a function of the decoded spectrum, so it does not need to be sent. Since the existing decoders can only decode the portion that is coded using the existing (baseband) codec, this means that the lower portion of the spectrum is coded with the existing codec and the higher portion is coded using the extended band coding using wide-sense perceptual similarity.

In other implementations where such backward compatibility is not needed, the encoder then has the freedom to choose between the conventional baseband coding and the extended band (wide-sense perceptual similarity approach) solely based on signal characteristics and the cost of encoding without considering the frequency location. For example, although it highly unlikely in natural signals, it may be better to encode the higher frequency with the traditional codec and the lower portion using the extended codec.

FIG. 4 is a flow chart depicting an audio encoding process (400) performed by the extended band coder (350) of FIG. 3 to encode the extended band spectral coefficients. In this audio encoding process (400), the extended band coder (350) divides the extended band spectral coefficients into a number of sub-bands. In a typical implementation, these sub-bands generally would consist of 64 or 128 spectral coefficients each. Alternatively, other size sub-bands (e.g., 16, 32 or other number of spectral coefficients) can be used. The sub-bands can be disjoint or can be overlapping (using windowing). With overlapping sub-bands, more bands are coded. For example, if 128 spectral coefficients have to be coded using the extended band coder with sub-bands of size 64, we can either use two disjoint bands to code the coefficients, coding coefficients 0 to 63 as one sub-band and coefficients 64 to 127 as the other. Alternatively we can use three overlapping bands with 50% overlap, coding 0 to 63 as one band, 32 to 95 as another band, and 64 to 127 as the third band.

For each of these sub-bands, the extended band coder (350) encodes the band using two parameters. One parameter ("scale parameter") is a scale factor which represents the total energy in the band. The other parameter ("shape parameter," generally in the form of a motion vector) is used to represent the shape of the spectrum within the band.

As illustrated in the flow chart of FIG. 4, the extended band coder (350) performs the process (400) for each sub-band of the extended band. First (at 420), the extended band coder (350) calculates the scale factor. In one implementation, the scale factor is simply the rms (root-mean-square) value of the coefficients within the current sub-band. This is found by taking the square root of the average squared value of all coefficients. The average squared value is found by taking the sum of the squared value of all the coefficients in the sub-band, and dividing by the number of coefficients.

The extended band coder (350) then determines the shape parameter. The shape parameter is usually a motion vector that indicates to simply copy over a normalized version of the spectrum from a portion of the spectrum that has already been coded (i.e., a portion of the baseband spectral coefficients coded with the baseband coder). In certain cases, the shape parameter might instead specify a normalized random noise vector or simply a vector for a spectral shape from a fixed codebook. Copying the shape from another portion of the spectrum is useful in audio since typically in many tonal signals, there are harmonic components which repeat throughout the spectrum. The use of noise or some other fixed codebook allows for a low bit-rate coding of those components which are not well represented in the baseband-coded portion of the spectrum. Accordingly, the process (400) provides a method of coding that is essentially a gain-shape vector quantization coding of these bands, where the vector is the frequency band of spectral coefficients, and the codebook is taken from the previously coded spectrum and can include other fixed vectors or random noise vectors, as well. That is each sub-band coded by the extended band coder is represented as a*X, where 'a' is a scale parameter and 'X' is a vector represented by the shape parameter, and can be a normalized version of previously coded spectral coefficients, a vector from a fixed codebook, or a random noise vector. Normalization of previously coded spectral coefficients or vectors from a codebook typically can include operations such as removing the mean from the vector and/or scaling the vector to have a norm of 1. Normalization of other statistics of the vector is also possible. Also, if this copied portion of the spectrum is added to a traditional coding of that same portion, then this addition is a residual coding. This could be useful if a traditional coding of the signal gives a base representation (for example, coding of the spectral floor) that is easy to code with a few bits, and the remainder is coded with the new algorithm.

In some alternative implementations, the extended band coder need not code a separate scale factor per subband of the extended band. Instead, the extended band coder can represent the scale factor for the subbands as a function of frequency, such as by coding a set of coefficients of a polynomial function that yields the scale factors of the extended subbands as a function of their frequency.

Further, in some alternative implementations, the extended band coder can code additional values characterizing the shape for an extended subband than simply the position (i.e., motion vector) of a matching portion of the baseband. For example, the extended band coder can further encode values to specify shifting or stretching of the portion of the baseband indicated by the motion vector. In such case, the shape parameter is coded as a set of values (e.g., specifying position, shift, and/or stretch) to better represent the shape of the extended subband with respect to a vector from the coded baseband, fixed codebook, or random noise vector.

In still other alternative implementations of the extended band coder (350), the scale and shape parameters that code each subband of the extended band can both be vectors. In one such implementation, the extended subbands are coded as the vector product (a(f)*X(f)) in the time domain of a filter with frequency response a(f) and an excitation with frequency response X(f). This coding can be in the form of a linear predictive coding (LPC) filter and an excitation. The LPC filter is a low order representation of the scale and shape of the extended subband, and the excitation represents pitch and/or noise characteristics of the extended subband. Similar to the illustrated implementation, the excitation typically can come from analyzing the low band (baseband-coded portion) of the spectrum, and identifying a portion of the baseband-coded spectrum, a fixed codebook spectrum or random noise that matches the excitation being coded. Like the illustrated implementation, this alternative implementation represents the extended subband as a portion of the baseband-coded spectrum, but differs in that the matching is done in the time domain.

More specifically, at action (430) in the illustrated implementation, the extended band coder (350) searches the baseband spectral coefficients for a like band out of the baseband spectral coefficients having a similar shape as the current sub-band of the extended band. The extended band coder determines which portion of the baseband is most similar to the current sub-band using a least-means-square comparison to a normalized version of each portion of the baseband. For example, consider a case in which there are 256 spectral coefficients produced by the transform (320) from an input block, the extended band sub-bands are each 16 spectral coefficients in width, and the baseband coder encodes the first 128 spectral coefficients (numbered 0 through 127) as the baseband. Then, the search performs a least-means-square comparison of the normalized 16 spectral coefficients in each extended band to a normalized version of each 16 spectral coefficient portion of the baseband beginning at coefficient positions 0 through 111 (i.e., a total of 112 possible different spectral shapes coded in the baseband in this case). The baseband portion having the lowest least-mean-square value is considered closest (most similar) in shape to the current extended band. At action (432), the extended band coder checks whether this most similar band out of the baseband spectral coefficients is sufficiently close in shape to the current extended band (e.g., the least-mean-square value is lower than a pre-selected threshold). If so, then the extended band coder determines a motion vector pointing to this closest matching band of baseband spectral coefficients at action (434). The motion vector can be the starting coefficient position in the baseband (e.g., 0 through 111 in the example). Other methods (such as checking tonality vs. non-tonality) can also be used to see if the most similar band out of the baseband spectral coefficients is sufficiently close in shape to the current extended band.

If no sufficiently similar portion of the baseband is found, the extended band coder then looks to a fixed codebook of spectral shapes to represent the current sub-band. The extended band coder searches this fixed codebook for a similar spectral shape to that of the current sub-band. If found, the extended band coder uses its index in the code book as the shape parameter at action (444). Otherwise, at action (450), the extended band coder determines to represent the shape of the current sub-band as a normalized random noise vector.

In alternative implementations, the extended band encoder can decide whether the spectral coefficients can be represented using noise even before searching for the best spectral shape in the baseband. This way even if a close enough spectral shape is found in the baseband, the extended band coder will still code that portion using random noise. This can result in fewer bits when compared to sending the motion vector corresponding to a position in the baseband.

At action (460), extended band coder encodes the scale and shape parameters (i.e., scaling factor and motion vector in this implementation) using predictive coding, quantization and/or entropy coding. In one implementation, for example, the scale parameter is predictive coded based on the immediately preceding extended sub-band. (The scaling factors of the sub-bands of the extended band typically are similar in value, so that successive sub-bands typically have scaling factors close in value.) In other words, the full value of the scaling factor for the first sub-band of the extended band is encoded. Subsequent sub-bands are coded as their difference of their actual value from their predicted value (i.e., the predicted value being the preceding sub-band's scaling factor). For multi-channel audio, the first sub-band of the extended band in each channel is encoded as its full value, and subsequent sub-bands' scaling factors are predicted from that of the preceding sub-band in the channel. In alternative implementations, the scale parameter also can be predicted across channels, from more than one other sub-band, from the baseband spectrum, or from previous audio input blocks, among other variations.

The extended band coder further quantizes the scale parameter using uniform or non-uniform quantization. In one implementation, a non-uniform quantization of the scale parameter is used, in which a log of the scaling factor is quantized uniformly to 128 bins. The resulting quantized value is then entropy coded using Huffman coding.

For the shape parameter, the extended band coder also uses predictive coding (which may be predicted from the preceding sub-band as for the scale parameter), quantization to 64 bins, and entropy coding (e.g., with Huffman coding).

In some implementations, the extended band sub-bands can be variable in size. In such cases, the extended band coder also encodes the configuration of the extended band.

More particularly, in one example implementation, the extended band coder encodes the scale and shape parameters as shown by the pseudo-code listing in the following code table:

Code Table.

```
for each tile in audio stream
{
    for each channel in tile that may need to be coded (e.g. subwoofer
may not need to be coded)
    {
        1 bit to indicate if channel is coded or not.
        8 bits to specify quantized version of starting position of
extended band.
        'n_config' bits to specify coding of band configuration.
        for each sub-band to be coded using extended band coder
        {
            'n_scale' bits for variable length code to specify scale
parameter (energy in band) .
            'n_shape' bits for variable length code to specify shape
parameter.
        }
    }
}
```

In the above code listing, the coding to specify the band configuration (i.e., number of bands, and their sizes) depends on number of spectral coefficients to be coded using the extended band coder. The number of coefficients coded using the extended band coder can be found using the starting position of the extended band and the total number of spectral coefficients (number of spectral coefficients coded using extended band coder=total number of spectral coefficients−starting position). The band configuration is then coded as an index into listing of all possible configurations allowed. This index is coded using a fixed length code with n_config=log2 (number of configurations) bits. Configurations allowed is a function of number of spectral coefficients to be coded using this method. For example, if 128 coefficients are to be coded, the default configuration is 2 bands of size 64. Other configurations might be possible, for example as listed in the following table.

| Listing of Band Configuration For 128 Spectral Coefficients | | | | |
|---|---|---|---|---|
| 0: | 128 | | | |
| 1: | 64 | | 64 | |
| 2: | 64 | | 32 | 32 |
| 3: | 32 | 32 | 64 | |
| 4: | 32 | 32 | 32 | 32 |

Thus, in this example, there are 5 possible band configurations. In such a configuration, a default configuration for the coefficients is chosen as having 'n' bands. Then, allowing each band to either split or merge (only one level), there are $5^{(n/2)}$ possible configurations, which requires (n/2)log2(5) bits to code. In other implementations, variable length coding can be used to code the configuration.

As discussed above, the scale factor is coded using predictive coding, where the prediction can be taken from previously coded scale factors from previous bands within the same channel, from previous channels within same tile, or from previously decoded tiles. For a given implementation, the choice for the prediction can be made by looking at which previous band (within same extended band, channel or tile (input block)) provided the highest correlations. In one implementation example, the band is predictive coded as follows:

Let the scale factors in a tile be x[i][j], where i=channel index, j=band index.

For i==0 && j==0 (first channel, first band), no prediction.

For i!=0 && j==0 (other channels, first band), prediction is x[0][0] (first channel, first band)

For i!=0 && j!=0 (other channels, other bands), prediction is x[i][j-1] (same channel, previous band).

In the above code table, the "shape parameter" is a motion vector specifying the location of previous spectral coefficients, or vector from fixed codebook, or noise. The previous spectral coefficients can be from within same channel, or from previous channels, or from previous tiles. The shape parameter is coded using prediction, where the prediction is taken from previous locations for previous bands within same channel, or previous channels within same tile, or from previous tiles.

Figure 5:
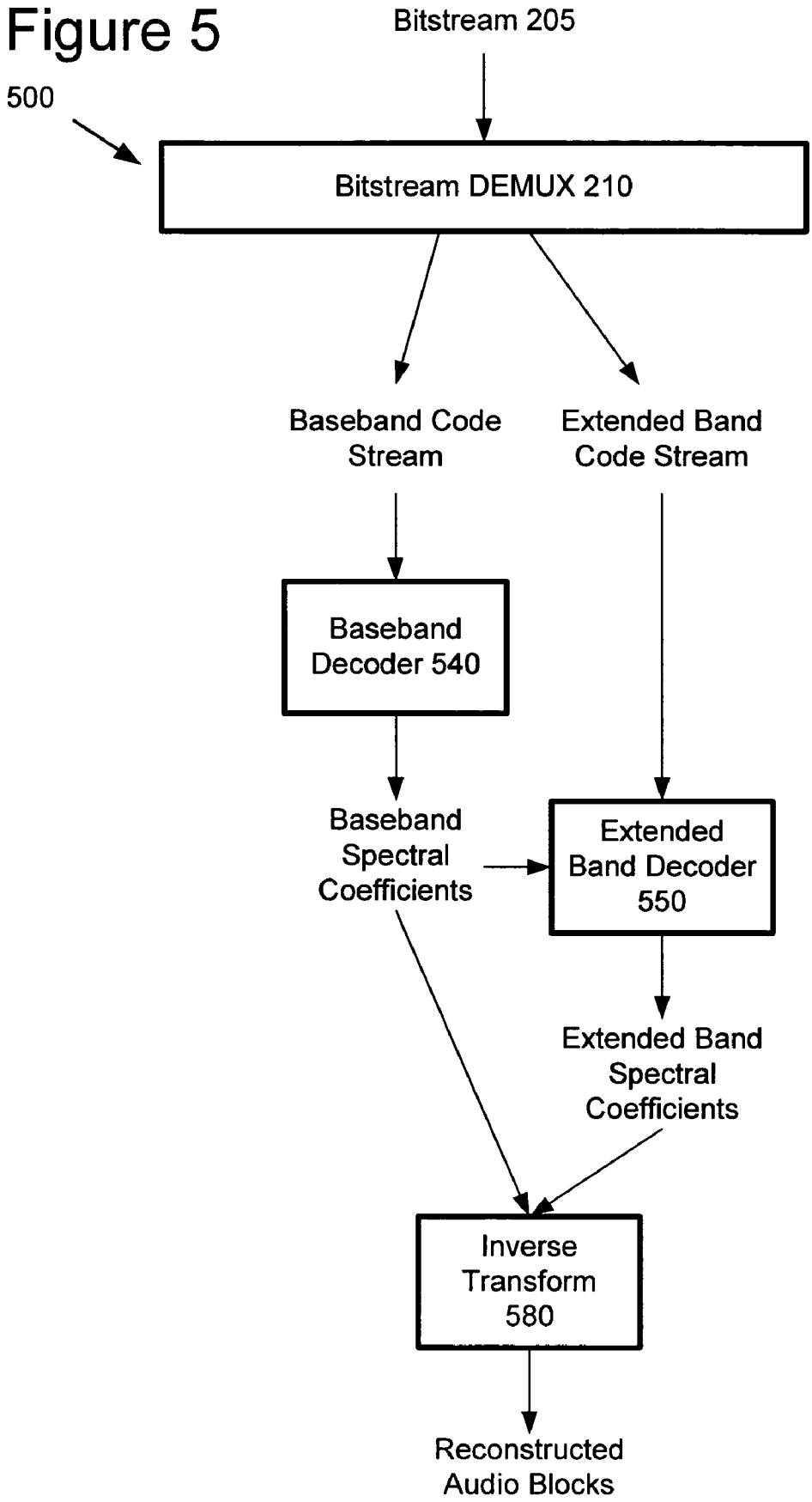
FIG. 5 is a block diagram of a baseband decoder and extended band decoder that can be incorporated into the general audio decoder of FIG. 2.

FIG. 5 shows an audio decoder (500) for the bitstream produced by the audio encoder (300). In this decoder, the encoded bitstream (205) is demultiplexed (e.g., based on the coded baseband width and extended band configuration) by bitstream demultiplexer (210) into the baseband code stream and extended band code stream, which are decoded in baseband decoder (540) and extended band decoder (550). The baseband decoder (540) decodes the baseband spectral coefficients using conventional decoding of the baseband codec. The extended band decoder (550) decodes the extended band code stream, including by copying over portions of the baseband spectral coefficients pointed to by the motion vector of the shape parameter and scaling by the scaling factor of the scale parameter. The baseband and extended band spectral coefficients are combined into a single spectrum which is converted by inverse transform 580 to reconstruct the audio signal.

Figure 6:
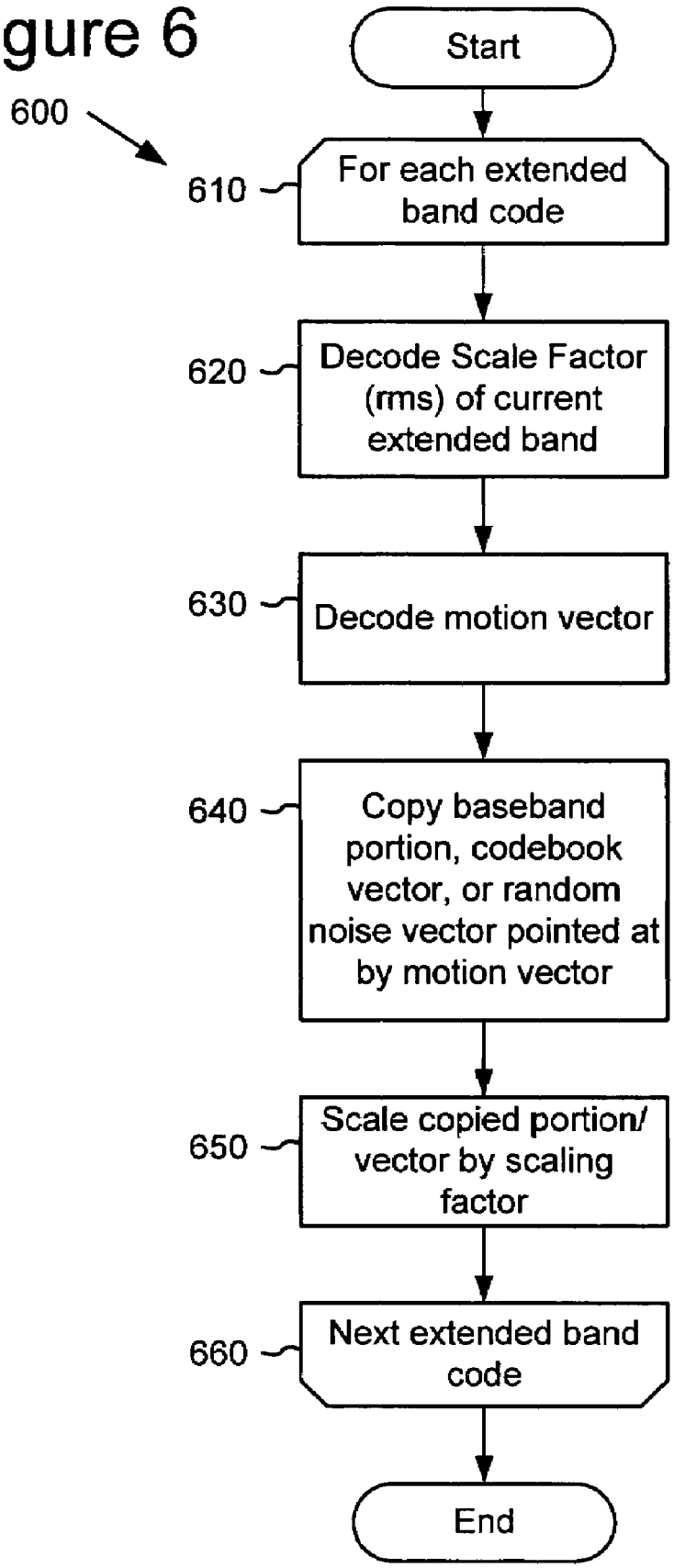
FIG. 6 is a flow diagram of decoding bands with the efficient audio coding using wide-sense perceptual similarity in the extended band decoder of FIG. 5.

FIG. 6 shows a decoding process (600) used in the extended band decoder (550) of FIG. 5. For each coded sub-band of the extended band in the extended band code stream (action (610)), the extended band decoder decodes the scale factor (action (620)) and motion vector (action (630)). The extended band decoder then copies the baseband sub-band, fixed codebook vector, or random noise vector identified by the motion vector (shape parameter). The extended band decoder scales the copied spectral band or vector by the scaling factor to produce the spectral coefficients for the current sub-band of the extended band.

5. Computing Environment

Figure 7:
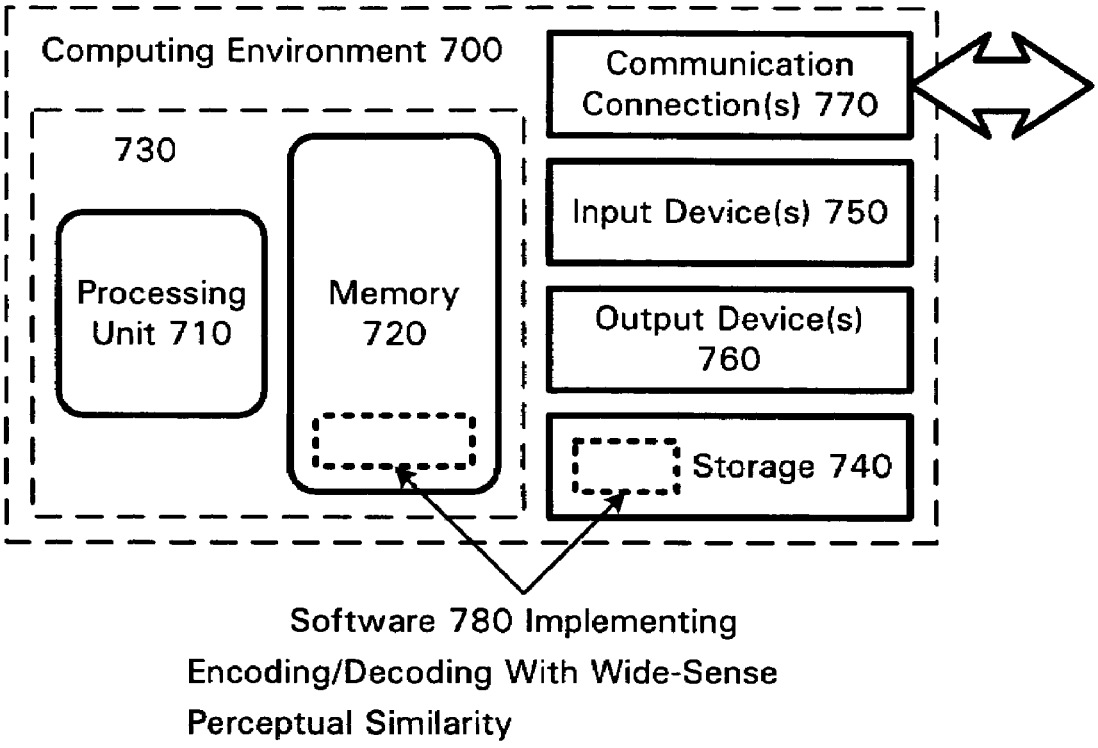
FIG. 7 is a block diagram of a suitable computing environment for implementing the audio encoder/decoder of FIG. 1.

FIG. 7 illustrates a generalized example of a suitable computing environment (700) in which the illustrative embodiments may be implemented. The computing environment (700) is not intended to suggest any limitation as to scope of use or functionality of the invention, as the present invention may be implemented in diverse general-purpose or special-purpose computing environments.

With reference to FIG. 7, the computing environment (700) includes at least one processing unit (710) and memory (720). In FIG. 7, this most basic configuration (730) is included within a dashed line. The processing unit (710) executes computer-executable instructions and may be a real or a virtual processor. In a multi-processing system, multiple processing units execute computer-executable instructions to increase processing power. The memory (720) may be volatile memory (e.g., registers, cache, RAM), non-volatile memory (e.g., ROM, EEPROM, flash memory, etc.), or some combination of the two. The memory (720) stores software (780) implementing an audio encoder.

A computing environment may have additional features. For example, the computing environment (700) includes storage (740), one or more input devices (750), one or more output devices (760), and one or more communication connections (770). An interconnection mechanism (not shown) such as a bus, controller, or network interconnects the components of the computing environment (700). Typically, operating system software (not shown) provides an operating environment for other software executing in the computing environment (700), and coordinates activities of the components of the computing environment (700).

The storage (740) may be removable or non-removable, and includes magnetic disks, magnetic tapes or cassettes, CD-ROMs, CD-RWs, DVDs, or any other medium which can be used to store information and which can be accessed within the computing environment (700). The storage (740) stores instructions for the software (780) implementing the audio encoder.

The input device(s) (750) may be a touch input device such as a keyboard, mouse, pen, or trackball, a voice input device, a scanning device, or another device that provides input to the computing environment (700). For audio, the input device(s) (750) may be a sound card or similar device that accepts audio input in analog or digital form. The output device(s) (760) may be a display, printer, speaker, or another device that provides output from the computing environment (700).

The communication connection(s) (770) enable communication over a communication medium to another computing entity. The communication medium conveys information such as computer-executable instructions, compressed audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (700), computer-readable media include memory (720), storage (740), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "get," "adjust," and "apply" to describe computer operations in a computing environment. These terms are high-level abstractions for operations performed by a computer, and should not be confused with acts performed by a human being. The actual computer operations corresponding to these terms vary depending on implementation.

In view of the many possible embodiments to which the principles of our invention may be applied, we claim as our invention all such embodiments as may come within the scope and spirit of the following claims and equivalents thereto.

We claim:

1. An audio encoding method, comprising:

transforming an input audio signal block into a set of spectral coefficients;

dividing the spectral coefficients into plural bands;

coding values of the spectral coefficients of at least one of the bands in an output bit stream;

for at least one of the other bands, coding said other band in the output bit-stream as a scaled version of a shape of a portion of the at least one of the bands coded as spectral coefficient values; and for each of plural other bands:

performing a search to determine which of a plurality of portions of the at least one bands coded as spectral coefficients is more similar in shape to the respective other band;

determining whether the determined portion is sufficiently similar in shape to the respective other band;

if so, coding the respective other band as a scaled version of the shape of the determined portion;

otherwise, coding the respective other band by:

performing a search among shapes represented in a fixed codebook for a shape that is more similar in shape to the respective other band;

if such similar shape is found in the fixed codebook, coding the respective other band as a scaled version of such similar shape in the fixed codebook; and otherwise, coding the respective other band as a scaled version of a random noise vector.

2. The audio encoding method of claim 1, wherein said performing the search to determine which of the plurality of portions of the at least one bands coded as spectral coefficients is more similar in shape to the respective other band comprises performing a least-means-square comparison to a normalized version of each of the plurality of portions.

3. The audio encoding method of claim 1, wherein said plurality of portions overlap one another.

4. One or more computer-readable storage media containing instructions configured to cause a computer to perform an audio encoding method, the method comprising:

transforming an input audio signal block into a set of spectral coefficients;

dividing the spectral coefficients into plural bands;

coding values of the spectral coefficients of at least one of the bands in an output bit stream;

for at least one of the other bands, coding said other band in the output bit-stream as a scaled version of a shape of a portion of the at least one of the bands coded as spectral coefficient values; and for each of plural other bands:

performing a search to determine which of a plurality of portions of the at least one bands coded as spectral coefficients is more similar in shape to the respective other band;

determining whether the determined portion is sufficiently similar in shape to the respective other band;

if so, coding the respective other band as a scaled version of the shape of the determined portion;

otherwise, coding the respective other band by:

performing a search among shapes represented in a fixed codebook for a shape that is more similar in shape to the respective other band;

if such similar shape is found in the fixed codebook, coding the respective other band as a scaled version of such similar shape in the fixed codebook; and otherwise, coding the respective other band as a scaled version of a random noise vector.

5. The one or more computer-readable storage media of claim 4, wherein said performing the search to determine which of the plurality of portions of the at least one bands coded as spectral coefficients is more similar in shape to the respective other band comprises performing a least-means-square comparison to a normalized version of each of the plurality of portions.

6. The one or more computer-readable storage media of claim 4, wherein said plurality of portions overlap one another.

7. A computing device comprising:

a processor; and one or more computer-readable storage media containing instructions configured to cause the computing device to perform an audio encoding method, the method comprising:

transforming an input audio signal block into a set of spectral coefficients;

dividing the spectral coefficients into plural bands;

coding values of the spectral coefficients of at least one of the bands in an output bit stream;

for at least one of the other bands, coding said other band in the output bit-stream as a scaled version of a shape of a portion of the at least one of the bands coded as spectral coefficient values; and for each of plural other bands:

performing a search to determine which of a plurality of portions of the at least one bands coded as spectral coefficients is more similar in shape to the respective other band;

determining whether the determined portion is sufficiently similar in shape to the respective other band;

if so, coding the respective other band as a scaled version of the shape of the determined portion; and otherwise, coding the respective other band by:

performing a search among shapes represented in a fixed codebook for a shape that is more similar in shape to the respective other band;

if such similar shape is found in the fixed codebook, coding the respective other band as a scaled version of such similar shape in the fixed codebook; and otherwise, coding the respective other band as a scaled version of a random noise vector.

8. The computing device of claim 7, wherein said performing the search to determine which of the plurality of portions of the at least one bands coded as spectral coefficients is more similar in shape to the respective other band comprises performing a least-means-square comparison to a normalized version of each of the plurality of portions.

9. The computing device of claim 7, wherein said plurality of portions overlap one another.

* * * * *

UNITED STATES PATENT AND TRADEMARK OFFICE

CERTIFICATE OF CORRECTION

PATENT NO. : 7,460,990 B2
APPLICATION NO. : 10/882801
DATED : December 2, 2008
INVENTOR(S) : Sanjeev Mehrotra et al.

It is certified that error appears in the above-identified patent and that said Letters Patent is hereby corrected as shown below:

In column 4, line 14, after "formats." insert

| Quality | Sample Depth (bits/sample) | Sampling Rate (samples/second) | Mode | Raw Bitrate (bits/second) |
|---|---|---|---|---|
| Internet telephony | 8 | 8,000 | mono | 64,000 |
| telephone | 8 | 11,025 | mono | 88,200 |
| CD audio | 16 | 44,100 | stereo | 1,411,200 |
| high quality audio | 16 | 48,000 | stereo | 1,536,000 |

Table 1: Bitrates for different quality audio information

-- --.

In column 9, line 33, before "highly" insert -- is --.

Signed and Sealed this
Ninth Day of August, 2011

David J. Kappos

David J. Kappos
*Director of the United States Patent and Trademark Office*